US007156671B2

(12) United States Patent
Kauth

(10) Patent No.: US 7,156,671 B2
(45) Date of Patent: Jan. 2, 2007

(54) ELECTRICAL CABLE CONNECTOR WITH GROUNDING INSERT

(76) Inventor: Donald A. Kauth, 101 Westgate Ave., Elk Grove, IL (US) 60007

( * ) Notice: Subject to any disclaimer, the term of this patent is extended or adjusted under 35 U.S.C. 154(b) by 0 days.

(21) Appl. No.: 11/321,852

(22) Filed: Dec. 29, 2005

(65) Prior Publication Data

US 2006/0141829 A1 Jun. 29, 2006

Related U.S. Application Data

(60) Provisional application No. 60/639,924, filed on Dec. 29, 2004.

(51) Int. Cl.
*H01R 4/66* (2006.01)
*H01R 13/648* (2006.01)

(52) U.S. Cl. ..... 439/98; 439/583

(58) Field of Classification Search ..... 439/98, 439/610, 583; 174/65 SS
See application file for complete search history.

(56) References Cited

U.S. PATENT DOCUMENTS 3,846,738 A * 11/1974 Nepovim ..... 439/584
4,885,429 A * 12/1989 Schnittker ..... 174/65 SS
4,952,174 A * 8/1990 Sucht et al. ..... 439/584
5,059,747 A * 10/1991 Bawa et al. ..... 174/65 SS
5,321,205 A * 6/1994 Bawa et al. ..... 174/65 SS
5,456,611 A * 10/1995 Henry et al. ..... 439/180
5,951,327 A * 9/1999 Marik ..... 439/610
6,639,146 B1 * 10/2003 Chiu ..... 174/35 R

* cited by examiner

*Primary Examiner*—Hae Moon Hyeon
(74) *Attorney, Agent, or Firm*—Gardner Carton & Douglas LLP

(57) ABSTRACT

The present invention provides a connector for an electrical cable comprising a grounding insert comprising: a bushing having a tapered forward end and a tapered rearward end, and a plurality of conductive fingers, wherein each conductive finger has a proximal end that is embedded in the tapered rearward end of the bushing and a distal end that extends from the tapered rearward end of the bushing to a contact site with a cable.

20 Claims, 3 Drawing Sheets

ELECTRICAL CABLE CONNECTOR WITH GROUNDING INSERT

CROSS-REFERENCE TO RELATED PATENT APPLICATIONS

This patent application claims the benefit of U.S. Provisional Patent Application No. 60/639,924, filed Dec. 29, 2004, which is herein incorporated by reference in its entirety.

FIELD OF THE INVENTION

This invention generally relates to an electrical cable connector and more particularly to an electrical cable connector comprising a grounding insert.

BACKGROUND OF THE INVENTION

Electrical cables are used in a wide variety of applications and in a wide variety of environments, including in hazardous conditions. It is increasingly important, in this regard, for cables to be securely isolated from their surrounding environments, in order to maximize performance of systems utilizing cables and to ensure the safety of individuals in the vicinity of such systems. Points in cable systems that are particularly susceptible to corrosion and leakage from the surrounding environment include connection sites between different cables and sites where cables terminate. Accordingly, the design and configuration of electrical cable connectors which function to terminate and connect cables in most conventional cable systems have become increasingly important for ensuring maximal protection of cables from the surrounding environment. A particularly important feature of electrical connectors, in this regard, is the grounding element, which is crucial for maximizing safety associated with the connector.

There have been many efforts to produce an electrical connector having a grounding element. Such a conventional connector is disclosed in U.S. Pat. No. 5,951,327, for example, which is incorporated herein by reference.

BRIEF SUMMARY OF THE INVENTION

A connector is provided for an electrical cable with a grounding insert comprising: a bushing having a tapered forward end and a tapered rearward end, and a plurality of conductive fingers, wherein each conductive finger has a proximal end that is embedded in the tapered rearward end of the bushing and a distal end that extends from the tapered rearward end of the bushing to a contact site with a cable.

These and other advantages of the invention, as well as additional inventive features, will be apparent from the description of the invention provided herein.

DETAILED DESCRIPTION OF THE INVENTION

Figure 1:
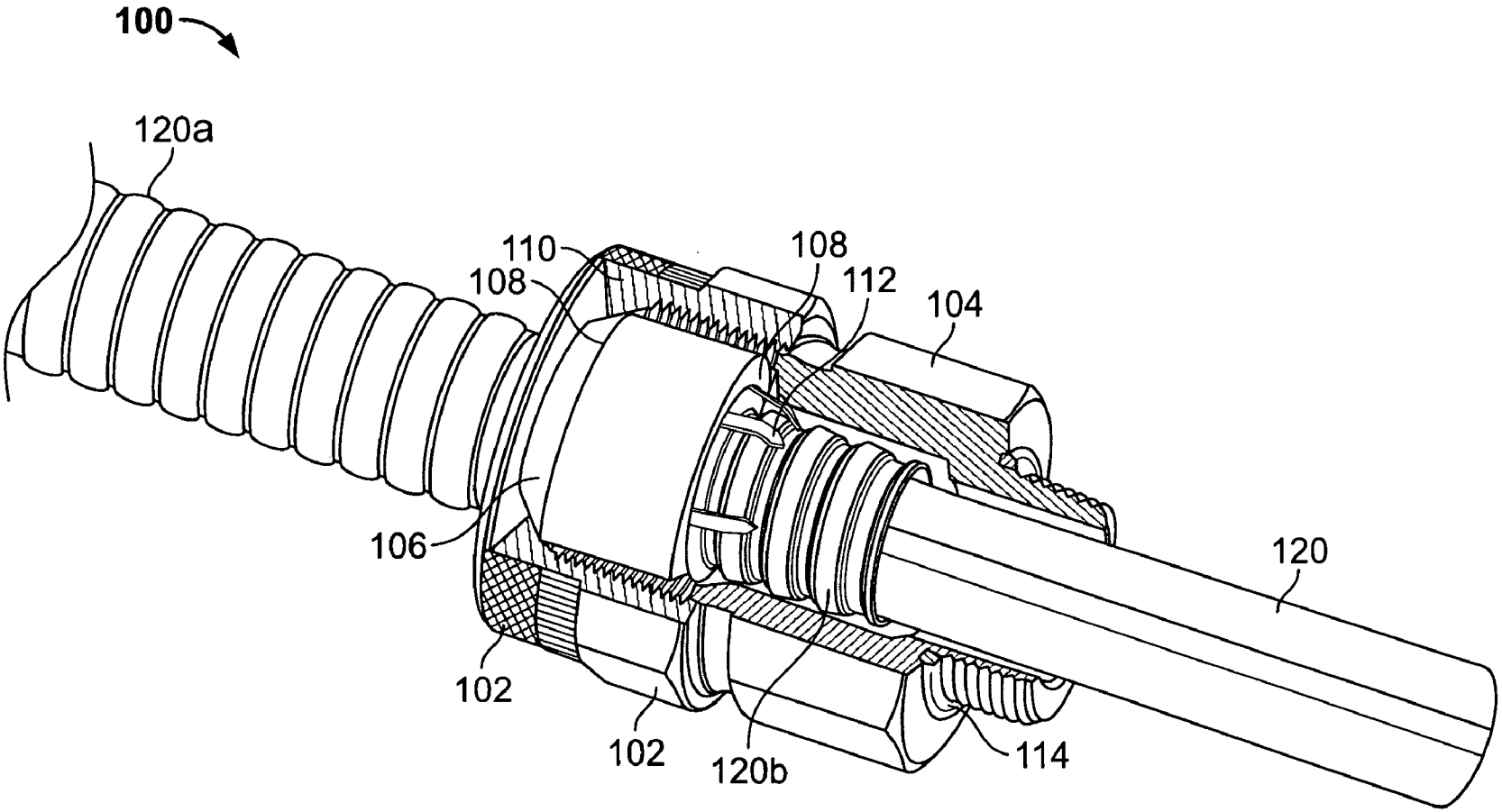
FIG. 1 is a side view of a connector having a portion broken away to show a grounding insert in accordance with teachings of the present invention.
Figure 2:
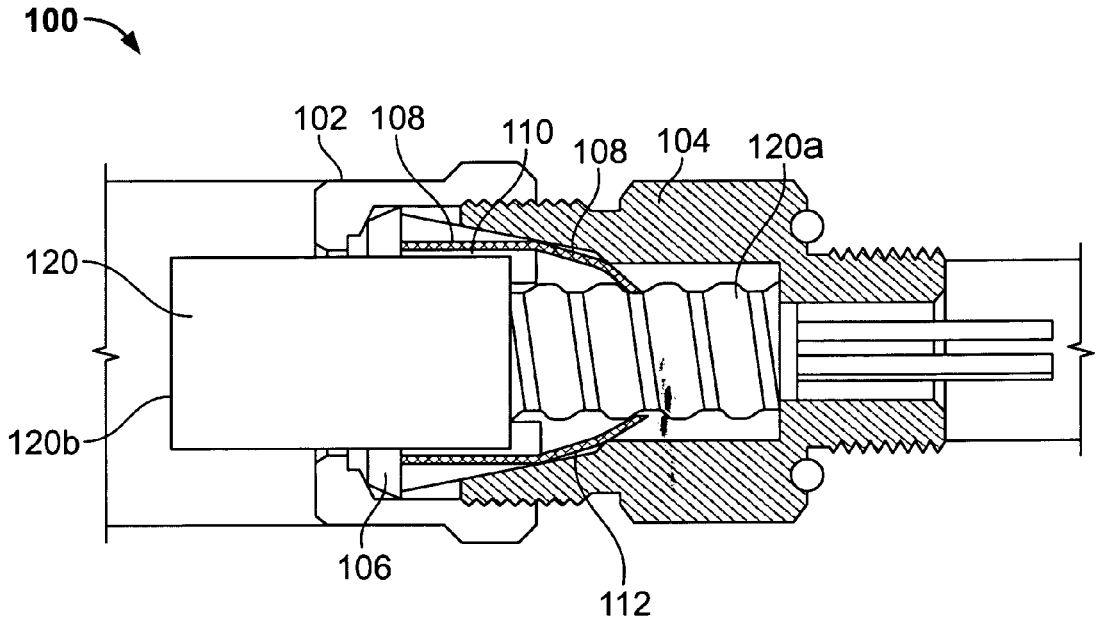
FIG. 2 is a side sectional view of a connector having a grounding insert in accordance with teachings of the present invention.
Figure 3:
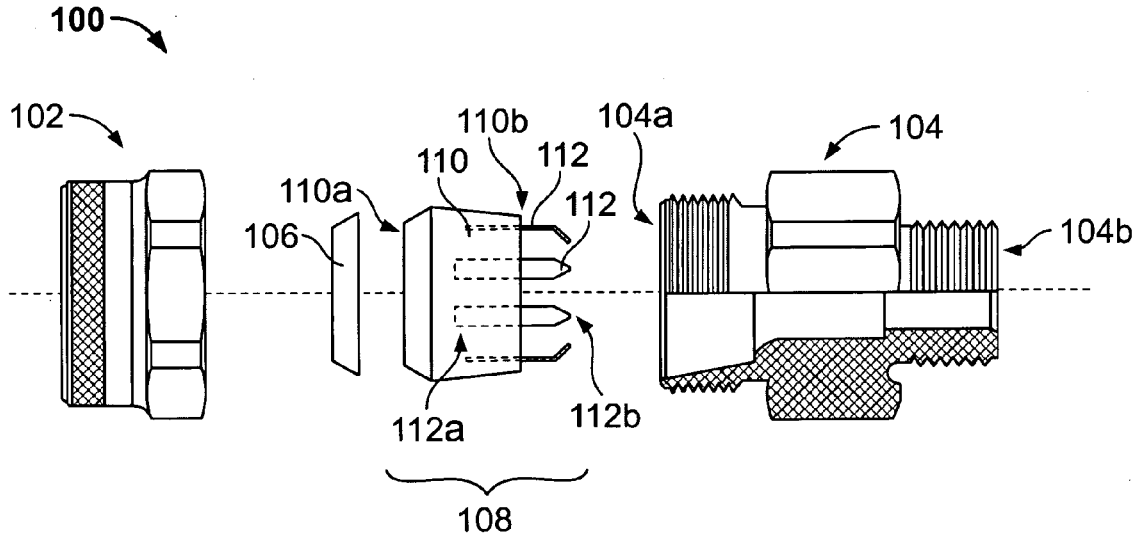
FIG. 3 is an exploded side view of a connector having a grounding insert in accordance with teachings of the present invention.

The following examples further illustrate the preferred embodiments but, of course, should not be construed as in any way limiting the scope of the invention. Referring to the drawings, FIGS. 1–3 illustrate a connector 100 in accordance with teachings of the present invention. Referring to FIGS. 1 and 2, the connector 100 includes a gland nut 102, a connector body 104, a compression ring 106, a grounding insert 108 comprising a bushing 110 and a plurality of conductive fingers 112 that project or extend from one end of the bushing 110 of the grounding insert 108, and a sealing ring 114. Moreover, a central hollow channel or core (not visible in the Figures) extends through the connector 100 along the longitudinal axis.

Referring specifically to FIGS. 1 and 2, the connector 100 is depicted as operably connected to a cable 120. The connector 100 of the present invention, in this regard, can be used to terminate or connect any suitable cable 120. Preferably, the connector 100 is used to terminate or connect a jacketed metal clad (MC) cable or an armor clad cable. As depicted in FIGS. 1–3, a MC cable 120 typically includes an outer insulation layer 120*a* and a metallic cladding or sheathing 120*b*. In typical use, the insulation layer 120*a* of a cable 120 is stripped so as to expose a portion of the metallic cladding 120*b* for termination within the connector 100.

Referring again to FIG. 3, the connector body 104 preferably comprises a threaded receiving end 104*a*, which is externally screw-threaded, and a threaded opposing end 104*b*, which is also externally screw-threaded for attachment, for example, to another device (e.g., an electrical or mechanical device). Moreover, as shown in FIG. 1, the connector body 104 preferably comprises a sealing ring 114 at the threaded opposing end 104*b* of the connector body 104 for ensuring a water-tight and corrosion-resistant termination seal with another device. The gland nut 102 of the connector 100 preferably is internally screw-threaded for screw-cooperation with the threaded receiving end 104*a* of the connector body 104, and preferably has an outer configuration which enables a user to screw the gland nut 102 and the connector body 104 with relative ease. The connector body 104 and the gland nut 102, in this regard, can be made out of any suitable material, such as for example, aluminum, nickel-plated aluminum, and stainless steel.

The grounding insert 108 will now be described in further detail. As illustrated in FIGS. 1–6, the grounding insert 108 comprises a bushing 110 and a plurality of conductive fingers 112 that project or extend from one end of the bushing 110. Moreover, referring specifically to FIG. 3, the bushing 110 comprises a tapered forward end 110*a* which engages a complementarily-shaped compression ring 106 and a tapered rearward end 110*b* which engages the threaded receiving end 104*a* of the connector body 104. The bushing 110 may be non-conductive and is preferably made of a resilient material such as rubber or any suitable elastomer.

Figure 4:
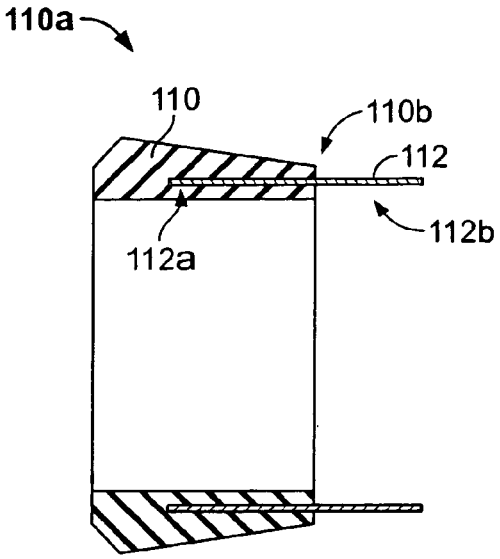
FIG. 4 is a side sectional view of a bushing and conductive fingers in accordance with teachings of the present invention.
Figure 5:
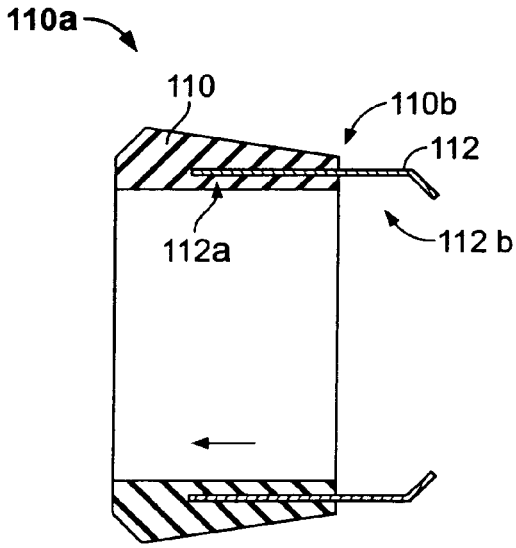
FIG. 5 is a side sectional view of a busing and conductive fingers in accordance with teachings of the present invention.
Figure 6:
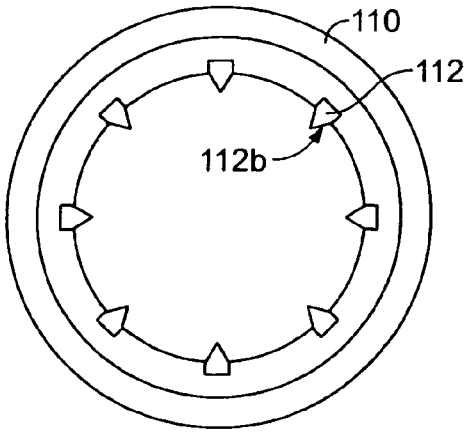
FIG. 6 is a front view of a bushing and conductive fingers in accordance with teachings of the present invention.

Each of the plurality of conductive fingers 112 preferably comprises a proximal end 112*a* that is embedded or contained in the rearward end 110*b* of the bushing 110 and a distal end 112*b* that projects or extends from the tapered rearward end 110*b* of the bushing 110. In this regard, the bushing 110 and the conductive fingers 112, which are embedded in the tapered rearward end 110*b* of the bushing 110, combine to form a single component grounding insert that is characterized by simplification of manufacture and use, and by superior properties, such as, for example, superior pole-out and sealing protection. The distal end 112*b* of each contact element 112 preferably projects or extends from all or substantially all of the circumferential front edge of the tapered rearward end 110*b* of the bushing 110. Referring now to FIG. 6, a top view of the grounding insert 108 is depicted. As is illustrated in FIG. 6, the conductive fingers 112 of the grounding insert 108 can be embedded into the bushing 110 in a circumferential or radial manner. This radial configuration of the conductive fingers 112, inter alia, ensures maximum contact in grounding of a cable 120 and 360° strain relief. The distal end 112*b* of each contact element 112 preferably also has an angled portion that is bent towards the central longitudinal channel or core of the connector 100, such that maximum potential contact can occur between the conductive fingers 112 and the metal sheathing 120*b* of cables 120, thereby resulting in maximum grounding of the cables 120. FIGS. 4 and 5, respectively, in this regard, depict a grounding insert 108 before and after the distal ends 112*b* of the conductive fingers 112 have been bent towards the central longitudinal channel or core of the connector 100. The conductive fingers, in this regard, can comprise any suitable electrically conductive material, preferably stainless steel.

FIGS. 1 and 2 illustrate a grounding insert 108 that includes a bushing 110 and a plurality of conductive fingers 112 which is situated between the connector body 104 and the gland nut 102. Preferably, the bushing 110 of the grounding insert 108, in this regard, is directable, moveable, or pushable towards and into the threaded receiving end 104*a* of the connector body 104 upon screw engagement of the gland nut 102 with the connector body 104. A compression ring 106 can be employed in the connector 100 of the present invention to ensure uniform compression and uniform movement of the bushing 110 of the grounding insert 108 into the threaded receiving end 104*a* of the connector body 104, such that the bushing inserts in a straight manner, thus ensuring a maximally-watertight connection. The compression ring 106 preferably, in this regard, has a complementary shape to the tapered forward end 110*a* of the bushing 110 such that it can be uniformly and stably situated thereon. Movement of the bushing 110 of the grounding insert 108 toward and into the threaded receiving end 104*a* of the connector body 104, in turn, causes the plurality of conductive fingers 112 of the grounding insert 108 to move into mechanical and electrical engagement with the metallic cladding 120*b* of a cable 120 present in the connector 100. In other words, the distal end 112*b* of each conductive fingers 112 of the grounding insert 108 is moved inwardly toward the central longitudinal channel or core of the connector 100 upon screw engagement of the gland nut 102 with the connector body 104, due to movement of the bushing 110 of the grounding insert 108 toward and into the threaded receiving end 104*a* of the connector body 104 and such that it approaches a contact point with the metallic cladding 120*b* of an inserted cable 120.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A connector for an electrical cable, the connector comprised of:

a gland nut defining an opening that extends longitudinally therethrough;

a compression ring positioned in the opening adjacent to an end surface of the gland nut;

a grounding insert positioned within the opening adjacent to the compression ring, the grounding insert including a bushing having a forward end, a rearward end and a plurality of conductive fingers, wherein each conductive finger of the plurality has a first end embedded in the rearward end of the bushing, and a second end extending from the rearward end of the bushing; and a connector body received in the opening in the gland nut, the connector body defining an opening that extends longitudinally therethrough.

2. The connector of claim 1, wherein:

the connector body includes a threaded first end proximal to the gland nut;

the opening of the gland nut is threaded; and the connector body is screwed into the opening in the gland nut.

3. The connector of claim 1, wherein:

the connector body includes an end distal to the gland nut; and a sealing ring is positioned adjacent to the end of the connector body distal to the gland nut.

4. The connector of claim 3, wherein the end of the connector body distal to the gland nut is threaded.

5. The connector of claim 1, wherein:

the forward end is tapered;

the rearward end is tapered; and the plurality of conductive fingers extends from the tapered rearward end of the bushing.

6. The connector of claim 1, wherein the bushing is made of a non-conductive material.

7. The connector of claim 6, wherein the non-conductive material is a resilient material.

8. The connector of claim 1, wherein:

the rearward end of the bushing forms a circumferential edge; and the plurality of conductive fingers extend from substantially all of the circumferential edge.

9. The connector of claim 1, wherein:

the second end of each of the plurality of conductive fingers is angled toward a longitudinal axis extending through the connector.

10. The connector of claim 1, wherein the conductive fingers are made of stainless steel.

11. A grounding insert for use in a connector for an electrical cable, the grounding insert comprised of:

a bushing having a tapered forward end and a tapered rearward end, and a plurality of conductive fingers, each conductive finger of the plurality having a first end embedded in the tapered rearward end and a second end extending from the tapered rearward end.

12. The grounding insert of claim 11, wherein the bushing is made of a non-conductive material.

13. The grounding insert of claim 12, wherein the non-conductive material is a resilient material.

14. The grounding insert of claim 11, wherein:

the rearward end of the bushing forms a circumferential edge; and the plurality of conductive fingers extend from substantially all of the circumferential edge.

15. The grounding insert of claim 11, wherein:

the second end of each of the plurality of conductive fingers is angled toward a longitudinal axis extending through the connector.

16. The grounding insert of claim 11, wherein the conductive fingers are made of stainless steel.

17. A connector for an electrical cable, the connector including a gland nut defining a longitudinally-extending opening therethrough, a compression ring positioned in the longitudinally-extending opening adjacent to an end surface of the gland nut, a grounding insert configured within the longitudinally-extending opening adjacent to the compression ring, the grounding insert having a plurality of conductive fingers and a bushing, and a connector body received in the longitudinally-extending opening, wherein the improvement comprises each conductive finger of the plurality having a first end embedded in a rearward end of the bushing, and a second end extending from the rearward end of the bushing, the bushing electrically isolating each conductive finger of the plurality from an other conductive finger of the plurality.

18. The connector of claim 17 wherein:

the connector body includes a threaded first end proximal to the gland nut;

the longitudinally-extending opening of the gland nut is threaded; and the connector body is threadably coupled with the longitudinally-extending opening in the gland nut.

19. The connector of claim 17 wherein:

the connector body includes an end distal the gland nut; and a sealing ring is configured adjacent to the end of the connector body distal the gland nut.

20. The connector of claim 17 wherein the connector body includes a threaded end distal the gland nut.

* * * * *